US010023979B2

(12) United States Patent
Matsumoto et al.

(10) Patent No.: US 10,023,979 B2
(45) Date of Patent: Jul. 17, 2018

(54) BUNDLE OF CARBON FIBERS AND METHOD OF MANUFACTURING THE SAME

(71) Applicant: Toray Industries, Inc., Tokyo (JP)

(72) Inventors: Naohiro Matsumoto, Ehime (JP); Jun Watanabe, Ehime (JP); Haruki Okuda, Ehime (JP); Fumihiko Tanaka, Ehime (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 15/520,919

(22) PCT Filed: Oct. 23, 2015

(86) PCT No.: PCT/JP2015/079932
§ 371 (c)(1),
(2) Date: Apr. 21, 2017

(87) PCT Pub. No.: WO2016/068034
PCT Pub. Date: May 6, 2016

(65) Prior Publication Data

US 2017/0342602 A1 Nov. 30, 2017

(30) Foreign Application Priority Data

Oct. 29, 2014 (JP) ..... 2014-219933
Jun. 26, 2015 (JP) ..... 2015-128656
Aug. 7, 2015 (JP) ..... 2015-156706

(51) Int. Cl.
*D01F 9/22* (2006.01)
*D06M 15/31* (2006.01)
*D06M 101/40* (2006.01)

(52) U.S. Cl.
CPC ..... *D01F 9/22* (2013.01); *D06M 15/31* (2013.01); *D06M 2101/40* (2013.01)

(58) Field of Classification Search
CPC ..... D01F 9/22; D06M 15/31; D06M 2101/40
See application file for complete search history.

(56) References Cited

U.S. PATENT DOCUMENTS 6,103,211 A 8/2000 Matsuhisa et al.
2011/0038788 A1* 2/2011 Tanaka ..... D01F 6/18 423/447.2

(Continued)

FOREIGN PATENT DOCUMENTS

JP 58-163729 A 9/1983
JP 62-257422 A 11/1987

(Continued)

OTHER PUBLICATIONS

Supplementary European Search Report dated Jun. 1, 2017, of corresponding European Application No. 15855999.7.

*Primary Examiner* — Daniel C McCracken
(74) *Attorney, Agent, or Firm* — DLA Piper LLP (US)

(57) ABSTRACT

A bundle of carbon fibers has a value A obtained from a nonlinear approximation formula of a stress σ-strain ε curve in a tensile strength test of resin-impregnated strands and an orientation parameter Π (%) of crystallites in a wide-angle x-ray diffraction measurement which satisfy a predetermined relational expression, and has tensile strength with a predetermined value or more, and tensile modulus within a predetermined range and a product E×d/W of a ratio d/W of a single-fiber diameter d to a loop width W just before loop fracture evaluated by a single-fiber loop test and a tensile modulus E of the strands has a predetermined value or more, or apparent single-fiber stress has a predetermined value or more when the number of fiber breaks by a single-fiber fragmentation method for a single-fiber composite is 0.30 breaks/mm and when the number of the fiber breaks by the single-fiber fragmentation method for the single-fiber composite is 0.30 breaks/mm, the number of fiber breaks by a (Continued)

double-fiber fragmentation method for the single-fiber composite is within a predetermined range.

20 Claims, 1 Drawing Sheet

(56) References Cited

U.S. PATENT DOCUMENTS

| | | | |
|---|---|---|---|
| 2015/0361591 | A1 | 12/2015 | Watanabe et al. |
| 2016/0168761 | A1 | 6/2016 | Okuda et al. |
| 2017/0067187 | A1 | 3/2017 | Watanabe et al. |

FOREIGN PATENT DOCUMENTS

| | | | |
|---|---|---|---|
| JP | 5-214614 | A | 8/1993 |
| JP | 6-294020 | A | 10/1994 |
| JP | 9-170170 | A | 6/1997 |
| JP | 11-241230 | | 9/1999 |
| JP | 2006-152457 | A | 6/2006 |
| JP | 2009-242962 | A | 10/2009 |
| JP | 2009-256833 | | 11/2009 |
| JP | 2012-82541 | A | 4/2012 |
| JP | 2013-23778 | A | 2/2013 |
| JP | 2013-202803 | A | 10/2013 |
| JP | 2014-159564 | A | 9/2014 |
| JP | 2014-159664 | A | 9/2014 |
| JP | 2014-185402 | A | 10/2014 |
| JP | 2015-010290 | | 1/2015 |
| WO | 97/45576 | A1 | 12/1997 |

* cited by examiner

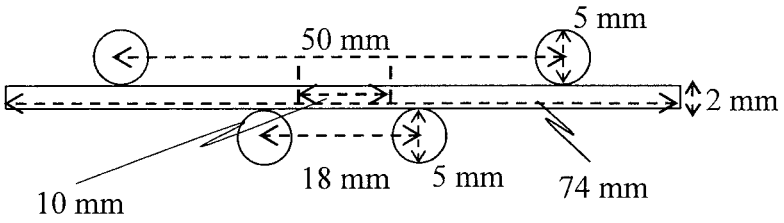
5 mm
50 mm
2 mm
10 mm
18 mm
5 mm
74 mm

BUNDLE OF CARBON FIBERS AND METHOD OF MANUFACTURING THE SAME

TECHNICAL FIELD

This disclosure relates to a bundle of carbon fibers for carbon fiber-reinforced composites and a method of manufacturing the same.

BACKGROUND

Due to increasing consciousness for environmental problems, much attention is paid to composites. Applications of carbon fiber as reinforced fiber for composites are spreading in various kinds of fields, and still higher performance is significantly required. Increasing tensile strength of carbon fiber contributes to weight reduction of components such as pressure vessels and, therefore, further increase in tensile strength thereof is an important issue.

In a brittle material such as a carbon fiber, tensile strength of the carbon fiber can be increased by reducing the flaw size of the carbon fiber or increasing the fracture toughness thereof according to Griffith's equation. Particularly, improvement in the fracture toughness of a carbon fiber is effective in that the tensile strength of the carbon fiber can be increased without depending on the state of the flaw size of the carbon fiber (WO 97/45576). Additionally, improvement in the fracture toughness of a carbon fiber is also effective in that tensile strength of a carbon fiber-reinforced composite obtained using the carbon fiber can be efficiently increased.

Until today, as methods of improving tensile strength and modulus of carbon fibers, there have been proposed methods in which an oxidation temperature is increased by using a plurality of ovens different in temperature in an oxidation process and methods in which, in an oxidation oven formed by a plurality of ovens, a precursor fiber for a carbon fiber having passed through each of the ovens is extended according to the density thereof (Japanese Unexamined Patent Application Publication No. S58-163729, Japanese Unexamined Patent Application Publication No. H06-294020, Japanese Unexamined Patent Application Publication No. S62-257422 and Japanese Unexamined Patent Application Publication No. 2013-23778). Additionally, there is a proposed method in which temperature control is performed by using two to three temperature control regions in an oxidation process to make difference in temperature between the regions (Japanese Unexamined Patent Application Publication No. 2012-82541).

Furthermore, techniques to increase torsional modulus of carbon fibers to improve compressive strength thereof are known (Japanese Unexamined Patent Application Publication No. H09-170170, Japanese Unexamined Patent Application Publication No. H05-214614 and Japanese Unexamined Patent Application Publication No. 2013-202803). In investigating the compressive strength of a single-fiber, a carbon fiber single-fiber loop test has been used hitherto (Japanese Unexamined Patent Application Publication No. H09-170170 and Japanese Unexamined Patent Application Publication No. 2014-185402). In Japanese Unexamined Patent Application Publication No. 2014-185402, a high compressive fracture strain has been obtained by using a carbon fiber having low tensile modulus and, in Japanese Unexamined Patent Application Publication No. H09-170170, the compressive strength of a carbon fiber has been increased by using an ion implantation technique. However, those techniques have not been sufficient to increase the tensile strength of the carbon fibers.

There are known techniques that control a single-fiber strength distribution of a short gauge length region of a carbon fiber to improve tensile modulus and open-hole tensile strength of a carbon fiber-reinforced composite (Japanese Unexamined Patent Application Publication No. 2014-159564 and Japanese Unexamined Patent Application Publication No. 2014-159664).

It is important to increase the fracture toughness of a carbon fiber and, to do so, it is essentially important to control the minute structure of the carbon fiber. The proposal of WO 97/45576 controls a silicone oil agent, a single-fiber fineness, and differences between skin-core structures to merely improve physical properties by controlling surface flaws or controlling a minute structure distribution, and does not intend improvement in the minute structure itself.

In Japanese Unexamined Patent Application Publication No. S58-163729, two to three temperature control regions are used in an oxidation process and treatment is performed at a temperature as high as possible in each region. However, the treatment requires as long as 44 to 60 minutes. In Japanese Unexamined Patent Application Publication No. H06-294020, short-time oxidation is performed by using two to three temperature control regions in an oxidation process and increasing heat treatment time in a high-temperature region and, accordingly, oxidation time at high temperature becomes long. Japanese Unexamined Patent Application Publication No. S62-257422 requires three to six ovens to set a plurality of stages for stretching levels in an oxidation oven or reduce oxidation time, but has not achieved satisfactory control of the minute structure of a carbon fiber. Japanese Unexamined Patent Application Publication No. 2013-23778 performs heat treatment for 10 to 120 seconds at 280 to 400° C. after setting a fiber specific gravity during an oxidation process to 1.27 or more. However, control of the minute structure of a carbon fiber has not been made satisfactorily only by the temperature increase in just a final stage of the process. Japanese Unexamined Patent Application Publication No. 2012-82541 controls so that the specific gravity of an oxidated thread after a first oxidation oven is 1.27 or more, and has not satisfactorily achieved minute structure control.

It is difficult to uniformly compare the torsional modulus of a carbon fiber in Japanese Unexamined Patent Application Publication No. H09-170170, Japanese Unexamined Patent Application Publication No. H05-214614 and Japanese Unexamined Patent Application Publication No. 2013-202803 with shear modulus described later, but the following things can be said about the torsional modulus therein. Japanese Unexamined Patent Application Publication No. H09-170170 and Japanese Unexamined Patent Application Publication No. H05-214614 use ion implantation and electron beam irradiation to increase the torsional modulus of a carbon fiber. The obtained carbon fiber contains lattice defects due to covalent bond cleavage and realignment. Thus, the shear modulus of the carbon fiber becomes unsatisfactory, and association with the tensile strength of the carbon fiber is also not considered. Japanese Unexamined Patent Application Publication No. 2013-202803 relates to a carbon fiber that is expected to exhibit physical properties equivalent to a carbon fiber having usual single-fiber fineness, although large in single-fiber fineness. Specifically, a carbon fiber having a shear modulus of 4 GPa or more is disclosed, but has never reached any satisfactory level.

Japanese Unexamined Patent Application Publication No. H09-170170 and Japanese Unexamined Patent Application Publication No. 2014-185402 have not been intended to increase the tensile strength of a carbon fiber and, as a matter of fact, the tensile strength of a carbon fiber determined by its loop shape is not high.

Japanese Unexamined Patent Application Publication No. 2014-159564 has improved open-hole tensile strength by controlling the single-fiber strength distribution of the short gauge length region of a carbon fiber, but has some room for improvement in terms of achieving balance with tensile strength of resin-impregnated strands. Japanese Unexamined Patent Application Publication No. 2014-159664 controls the single-fiber strength distribution of the short gauge length region of a carbon fiber by narrowing the single-fiber diameter of the carbon fiber so that flaws are reduced. There is still some room for improvement to efficiently improve tensile modulus and open-hole tensile strength of carbon fiber-reinforced composites.

It could therefore be helpful to provide a carbon fiber (a bundle of carbon fibers) from which a carbon fiber-reinforced composite having high tensile strength can be obtained and a method of manufacturing the same.

SUMMARY

We thus provide:

A first aspect of the bundle of carbon fibers is a bundle of carbon fibers in which a relationship between a coefficient A obtained from a nonlinear approximation formula (1) of a stress σ-strain ε curve in a tensile strength test of resin-impregnated strands and an orientation parameter Π (%) of crystallites in a wide-angle x-ray diffraction measurement satisfies formula (2) and whose tensile strength is 7.5 GPa or more:

$$\varepsilon = A\sigma^2 + B\sigma + C \quad (1)$$

$$0.0000832\Pi^2 - 0.0184\Pi + 1.00)/A \leq -395 \quad (2)$$

wherein Π represents an orientation parameter (%) of crystallites in the x-ray diffraction measurement.

A second aspect is a bundle of carbon fibers whose tensile modulus in a tensile strength test of resin-impregnated strands is 240 to 440 GPa and in which a product E×d/W of a ratio d/W of a single-fiber diameter d to a loop width W just before loop fracture evaluated by a single-fiber loop test and a tensile modulus E of the strands is 14.6 GPa or more.

A third aspect is a bundle of carbon fibers whose apparent single-fiber stress is 8.5 GPa or more when the number of fiber breaks in a single-fiber fragmentation method for a single-fiber composite of a carbon fiber is 0.30 breaks/mm and in which when the number of the fiber breaks by the single-fiber fragmentation method for the single-fiber composite of the carbon fiber is 0.30 breaks/mm, the number of fiber breaks by a double-fiber fragmentation method for the single-fiber composite of the carbon fiber is 0.24 to 0.42 breaks/mm.

In addition, a method of manufacturing a bundle of carbon fibers includes: performing a first oxidation process that oxidates a precursor fiber bundle for a polyacrylonitrile-based carbon fiber for 8 to 25 minutes until a ratio of a peak intensity at 1453 $cm^{-1}$ to a peak intensity at 1370 $cm^{-1}$ in an infrared spectrum is 0.98 to 1.10; additionally performing a second oxidation process that oxidates for 5 to 14 minutes until the ratio of the peak intensity at 1453 $cm^{-1}$ to the peak intensity at 1370 $cm^{-1}$ in the infrared spectrum is 0.70 to 0.75 and a ratio of a peak intensity at 1254 $cm^{-1}$ to the peak intensity at 1370 $cm^{-1}$ in the infrared spectrum is 0.50 to 0.65 to obtain an oxidated fiber bundle; and then, performing a carbonization process that carbonizes the oxidated fiber bundle in an inert atmosphere at 1000 to 3000° C.

There can be obtained a bundle of carbon fibers that can provide a high-performance carbon fiber-reinforced composite that exhibits excellent tensile strength.

BRIEF DESCRIPTION OF THE DRAWINGS

FIG. 1 is a diagram depicting a measurement method in a 4-point bending test.

DETAILED DESCRIPTION

We found that when nonlinearity of a stress-strain curve obtained by a tensile strength test of resin-impregnated strands (hereinafter also simply abbreviated as strands) of a bundle of carbon fibers is small and a change of tensile modulus with respect to tensile strain is small, the carbon fiber tends to have high fracture toughness and high tensile strength. The tensile strength test of strands is a simple and easy testing method of evaluating characteristics of a bundle of carbon fibers. The stress-strain curve of a bundle of carbon fibers generally exhibits a downward protruding curve when stress is represented by a vertical axis and strain is represented by a horizontal axis. This indicates that the tensile modulus of the bundle of carbon fibers increases as tensile strain is increased. The nonlinearity of the stress-strain curve correlates with shear modulus of the carbon fiber, and the higher the shear modulus, the smaller the nonlinearity of the stress-strain curve. We consequently obtained a carbon fiber having high shear modulus by controlling conditions of manufacturing a carbon fiber so that the stress-strain curve of the carbon fiber had small nonlinearity, as a result of which we found that not only does the bundle of carbon fibers have high tensile strength, but also tensile strength at 0° of a carbon fiber-reinforced composite obtained can be effectively increased.

Specifically, in a first aspect of a bundle of carbon fibers, a stress σ-strain ε curve obtained by measuring a bundle of carbon fibers by the tensile strength test of resin-impregnated strands is introduced into nonlinear approximation formula (1) to obtain a coefficient A that satisfies formula (2):

$$\varepsilon = A\sigma^2 + B\sigma + C \quad (1)$$

$$0.0000832\Pi^2 - 0.0184\Pi + 1.00)/A \leq -395 \quad (2)$$

Π represents an orientation parameter (%) of crystallites obtained by measuring the bundle of carbon fibers by a wide-angle x-ray diffraction measurement.

In formula (1), the coefficient A represents the nonlinearity of the stress-strain curve. The coefficient A is obtained by fitting a stress σ (GPa)-strain ε (−) curve that is obtained by measuring the bundle of carbon fibers by the tensile strength test of resin-impregnated strands into formula (1) in a stress range of 0 to 3 GPa. As described above, the stress-strain curve of a bundle of carbon fibers generally exhibits a downward protruding curve when stress is represented by the vertical axis and strain is represented by the horizontal axis. Thus, the coefficient A obtained from formula (1) has a negative value. In other words, this means that the closer the coefficient A is to "0", the smaller the nonlinearity.

Additionally, we found that the correlation of only the nonlinearity of a stress-strain curve with the shear modulus of a carbon fiber is not always sufficient. Theories relating to stress and deformation in carbon fibers are explained in, for example, "Carbon" (Netherlands), Elsevier, 1991, Vol. 29, No. 8, p. 1267-1279, and the like. However, this is an academic study and thus, it is difficult to use in practical studies for improving the strength of a carbon fiber. We found that an orientation parameter 11 of crystallites that is relatively easily measured from a practical viewpoint and the value of the left side of formula (2) "$(0.0000832\Pi^2-0.0184\Pi+1.00)/A$" derived from the coefficient A of formula (1) is significantly highly correlated with the shear modulus of a carbon fiber.

As described above, since the coefficient A has a negative value, the value of the left side of formula (2) has a negative value. The larger the absolute value of the value of the left side of formula (2), the higher the shear modulus of a carbon fiber tends to be. The value of the left side of formula (2) is −395 or less, preferably −436 or less, and more preferably −445 or less. When the value of the left side of formula (2) is more than −395, the tensile strength of the carbon fiber is reduced.

Although carbon fibers with increased tensile strength have already been available, a factor for that has mainly been an effect due to reduction of flaws, and stress-strain curve control has not been possible.

In the bundle of carbon fibers, the range of the coefficient A is preferably $-1.20\times10^{-4}$ or more, more preferably $-9.8\times10^{-5}$ or more, more preferably $-9.5\times10^{-5}$ or more, and still more preferably $-9.3\times10^{-5}$ or more. When the nonlinearity of the stress-strain curve becomes weak, the coefficient A increases and comes close to "0". The closer the coefficient A comes to "0", the higher the shear modulus of the bundle of carbon fibers, and the higher the fracture toughness. To reduce the nonlinearity of the stress-strain curve, a method of manufacturing a bundle of carbon fibers described later may be used.

In a first aspect of the bundle of carbon fibers, the tensile strength is 7.5 GPa or more, preferably 7.7 GPa, and more preferably 7.9 GPa. The value of the tensile strength is a value evaluated by the tensile strength test of resin-impregnated strands of the bundle of carbon fibers. When the tensile strength is 7.5 GPa or more, there are few flaws in the carbon fiber so that the fracture toughness of the carbon fiber becomes dominant over the tensile strength. When there are many flaws in the carbon fiber, the tensile strength may not be improved even if the fracture toughness of the carbon fiber is increased. Although there is no particular upper limit to the tensile strength, it is empirically about 10 GPa. To increase the fracture toughness of the bundle of carbon fibers and thereby increase the tensile strength thereof, the method of manufacturing a bundle of carbon fibers described later may be used.

In a second aspect of the bundle of carbon fibers, a product E×d/W of a ratio d/W of a single-fiber diameter d to a loop width W just before loop fracture evaluated by a single-fiber loop test and a tensile modulus E of strands is 14.6 GPa or more, preferably 15.0 GPa or more, and more preferably 15.2 GPa or more. The single-fiber loop test is a technique to investigate the relationship between a strain applied to a single-fiber by deforming the single-fiber into a loop shape and fracture behaviors such as single-fiber fracture and buckling. When the single-fiber is deformed into a loop shape, a compressive strain is applied to the inside of the single-fiber, and a tensile strain is applied to the outside thereof. Compressive buckling occurs before tensile fracture. Thus, conventionally, the single-fiber loop test has often been used as a method of testing single-fiber compressive strength of carbon fibers. Evaluating a tensile strain at the time of tensile fracture allows evaluation of a value that can be said to be an intrinsic tensile strength of the carbon fiber. In other words, the ratio d/W is a value proportional to tensile strain, and the product of the value and the tensile modulus E of strands (the details thereof will be described later) is a value corresponding to tensile strength. Even if merely the tensile strength of resin-impregnated strands is increased, tensile strength of a carbon fiber-reinforced composite may not be increased. However, by increasing the value of E×d/W, the tensile strength of a carbon fiber-reinforced composite can be effectively increased. When compared to commercially available carbon fibers and well-known carbon fibers, the tensile strength of a carbon fiber-reinforced composite is significantly increased by setting the value of E×d/W to 14.6 GPa or more (see Tables 4-1 and 6 presented later). Although there is no particular upper limit to the value of E×d/W, it is enough to set 19.0 GPa as the upper limit of the value of E×d/W. In addition, the parameter can be controlled by using the method of manufacturing a bundle of carbon fibers described later.

Additionally, in the carbon fiber described in Japanese Unexamined Patent Application Publication No. S58-163729, when a curvature radius just before loop fracture is converted into W in our method, the following things can be said. Specifically, assuming that the curvature radius just before loop fracture is W/2, the value of E×d/W becomes at most 14.1 GPa when the tensile modulus of the carbon fiber is 142 to 252 GPa. The value of E×d/W of the conventional carbon fiber described in Japanese Unexamined Patent Application Publication No. S58-163729 can be estimated to be at this level.

In the second aspect of the bundle of carbon fibers, a tensile modulus in the tensile strength test of resin-impregnated strands (also simply abbreviated as tensile modulus of strands) is 240 to 440 GPa, preferably 280 to 400 GPa, and more preferably 310 to 400 GPa. When the tensile modulus is 240 to 440 GPa, it is preferable because there is an excellent balance between tensile modulus and tensile strength. The tensile modulus can be obtained by a method described in "Tensile Strength Test of Rein-Impregnated Strands of Carbon Fiber" described later. In this case, the range of strain is assumed to be 0.1 to 0.6%. The tensile modulus of the bundle of carbon fibers can be controlled by applying tension to the fiber bundle or changing a carbonization temperature mainly during any of heat treatment processes in a process of manufacturing the bundle of carbon fibers.

A Weibull shape parameter m in a Weibull plot of the value of E×d/W evaluated with respect to 20 single-fibers is preferably 12 or more. The Weibull plot is a technique widely used to evaluate strength distribution, and spread of the distribution can be seen by the Weibull shape parameter m. As for the Weibull plot, the values of E×d/W are numbered in ascending order, like 1, . . . , i, . . . , and 20, and the plot is drawn by setting a vertical axis as $\ln(-\ln(1-(i-0.5)/20))$ and a horizontal axis as $\ln(E\times d/W)$. In means a natural logarithm. When the plot is linearly approximated by the method of least squares, the Weibull shape parameter m can be obtained as an inclination. It is meant that the larger the Weibull shape parameter m, the narrower the strength distribution, and the smaller the Weibull shape parameter m, the wider the strength distribution. In an ordinary carbon fiber, the Weibull shape parameter m of tensile strength evaluated by a single-fiber tensile strength test often has a value around 5. This is understood to be due to a size distribution of large flaws. On the other hand, although details of the reason are not necessarily clear, we found that, in our carbon fiber, the Weibull shape parameter m of the value of E×d/W is significantly larger than around 5. Additionally, we found that when many flaws are present in the carbon fiber, the value of m becomes small due to bending of the Weibull plot. When the Weibull shape parameter m is 12 or more, it is preferable because flaws in the carbon fiber are sufficiently few.

In a third aspect of the bundle of carbon fibers, when the number of fiber breaks in a single-fiber fragmentation method of a single-fiber composite of the carbon fiber is 0.30 breaks/mm, an apparent single-fiber stress is 8.5 GPa or more, and when the number of the fiber breaks in the single-fiber fragmentation method of the single-fiber composite of the carbon fiber is 0.30 breaks/mm, the number of fiber breaks in a double-fiber fragmentation method of the single-fiber composite of the carbon fiber is 0.24 to 0.42 breaks/mm, preferably 0.24 to 0.37 breaks/mm, and more preferably 0.24 to 0.32 breaks/mm.

The single-fiber fragmentation method of a single-fiber composite is a technique to investigate a single-fiber strength distribution of a carbon fiber by counting the number of fiber breaks due to each strain while applying a strain stepwise to a composite in which one single-fiber of the carbon fiber is embedded in a resin. Measurement of the single-fiber strength of a carbon fiber by the single-fiber fragmentation method of a single-fiber composite is disclosed in "Advanced Composite Materials" (Japan), 2014, 23, 5-6, p. 535-550 and the like.

The double-fiber fragmentation method of a single-fiber composite is a technique to investigate a single-fiber strength distribution of a single fiber, particularly, in a high strength region by applying a strain stepwise to a composite in which two single-fibers of the carbon fiber are embedded in parallel at an interval of 0.5 μm to an average single-fiber diameter and counting the number of fiber breaks due to each stain. It is known that when a fracture occurs in the fiber in the composite, a stress that is high by several tens of percent is loaded to a place adjacent to a fractured portion, whereby an adjacent fiber(s) is(are) selectively fractured. In other words, by investing the number of fiber breaks in the double-fiber fragmentation method with respect to the number of fiber breaks in the single fiber fragmentation method, there can be investigated a single-fiber strength distribution of a carbon fiber in a state of an extremely high stress that cannot be loaded by the single fiber fragmentation method. When the interval between the two single-fibers of the carbon fiber exceeds the average single-fiber diameter, influence of the adjacent fiber(s) is hardly received and, therefore, high stress cannot be loaded. When the interval between the two single-fibers of the carbon fiber is less than 0.5 μm, determination of fiber fracture cannot be easily made. Due to this, the interval between the two single-fibers of the carbon fiber is set to be 0.5 μm to an average single-fiber diameter.

In the third aspect of the bundle of carbon fibers, when the number of the fiber breaks in the single-fiber fragmentation method of the single-fiber composite of the carbon fiber is 0.30 breaks/mm, the apparent single-fiber stress is 8.5 GPa or more. The apparent single-fiber stress refers to the product of a single-fiber composite strain and a single-fiber modulus of the carbon fiber. In the single-fiber fragmentation method, when the single-fiber composite strain is low, the number of fiber breaks is small, and a variation in the apparent single-fiber stress is large. Thus, it is favorable to set 0.30 breaks/mm as an index for the number of fiber breaks. When the apparent single-fiber stress applied when the number of fiber breaks in the single-fiber fragmentation method is 0.30 breaks/mm is 8.5 GPa or more, it means that the single-fiber strength distribution of a region with a gauge length of 3 to 10 mm in the carbon fiber is substantially high, so that the strands strength in the carbon fiber can be significantly increased.

Even if merely the tensile strength of resin-impregnated strands of the carbon fiber is increased by reduction of flaws or the like, the tensile strength of a carbon fiber-reinforced composite may not be increased. However, reducing fiber fracture in the double-fiber fragmentation method described above allows the tensile strength of the carbon fiber-reinforced composite to be effectively increased. When the number of fiber breaks by the single-fiber fragmentation method is 0.30 breaks/mm, the number of fiber breaks by the double-fiber fragmentation method is 0.30 breaks/mm if there is no influence of the adjacent fiber(s). However, considering a variation in the fiber fracture, it is 0.24 breaks/mm or more. When the number of fiber breaks by the double-fiber fragmentation method obtained when the number of fiber breaks by the single-fiber fragmentation method is 0.30 breaks/mm exceeds 0.42 breaks/mm, the single-fiber strength distribution of a high strength region becomes low. Accordingly, when high stress is loaded, the adjacent fiber(s) is(are) easily broken. In other words, one single-fiber fracture causes a cluster fracture, and the tensile strength of the carbon fiber-reinforced composite is not increased. Thus, the number of the fiber breaks described above is set to be 0.42 breaks/mm or less, preferably 0.37 breaks/mm or less, and more preferably 0.32 breaks/mm. In addition, the parameter can be controlled by using the method of manufacturing a bundle of carbon fibers described later.

In the third aspect of the bundle of carbon fibers, in the single-fiber fragmentation method of the single-fiber composite of the carbon fiber, when the apparent single-fiber stress is 15.3 GPa, the number of fiber breaks is preferably 2.0 breaks/mm or more, and more preferably 2.1 breaks/mm or more. When the number of the above fiber breaks is less than 2.0 breaks/mm, an interfacial adhesion between the carbon fiber and a matrix resin is reduced, whereby the fiber cannot share stress when the number of fiber breaks increases, as a result of which the tensile strength of a carbon fiber-reinforced composite may be reduced. Stress is transmitted to the fiber between fracture points due to interfacial shear between the resin and the carbon fiber from a fracture point where the stress sharing is "0". Particularly, when the number of fracture is increased in this way, the number of fiber breaks is saturated since fiber stress is hardly increased. Due to that, actual fiber stress is smaller than the apparent single-fiber stress. When the single-fiber modulus of the carbon fiber is low, the single-fiber composite may be broken before loading the apparent single-fiber stress up to 15. 3 GPa. However, when the number of fiber breaks is saturated, it is possible to substitute the number of the fiber breaks instead. "Being saturated" refers to a state where when a change in the single-fiber composite strain is assumed to be Δ1%, an increase in the number of fiber breaks is Δ0.2 breaks/mm or less.

An orientation parameter of crystallites in the bundle of carbon fibers is preferably 82% or more, more preferably 83% or more, and still more preferably 85% or more. The upper limit of the orientation parameter of crystallites is 100% in principle. Due to increased orientation parameter of crystallites under stress, the stress-strain curve of the bundle of carbon fibers exhibits nonlinearity. The higher the orientation parameter of crystallites in the bundle of carbon fibers before loading of stress is, the more the crystallites share stress, and thus the tensile strength is easily increased, which is therefore preferable. The orientation parameter of crystallites in the bundle of carbon fibers can be obtained by a method described in "Orientation Parameter of Crystallites in Bundle of carbon fibers" described later. The orientation parameter of crystallites in the bundle of carbon fibers can be increased by applying tension to the bundle of carbon fibers or increasing a carbonization temperature mainly in the heat treatment processes.

The bundle of carbon fibers has a single-fiber diameter of preferably 4.5 to 7.5 μm, and more preferably 5.0 to 7.0 μm. The smaller the single-fiber diameter is, the less the flaws tend to be. When the single-fiber diameter is 4.5 to 7.5 μm, the tensile strength becomes stable, which is therefore preferable. The single-fiber diameter can be calculated from a mass and a specific gravity per unit length of the bundle of carbon fibers.

The initial Young's modulus in the tensile strength test of resin-impregnated strands of the bundle of carbon fibers is preferably 280 GPa or more, more preferably 300 GPa or more, and still more preferably 320 GPa or more. It is usually known that the higher the initial Young's modulus, the lower the tensile strength. It is preferable that the initial Young's modulus is 280 GPa or more and any of the first through third aspects is satisfied, because there is an excellent balance between tensile modulus and tensile strength. The initial Young's modulus is calculated by 1/B from formula (1) of the stress-strain curve obtained by the tensile strength test of resin-impregnated strands. In many cases, the initial Young's modulus is about 90% of a tensile modulus as indicated by a catalog value. The initial Young's modulus of the bundle of carbon fibers can be controlled by applying tension to the fiber bundle or changing a carbonization temperature mainly during any of the heat treatment processes in a process of manufacturing the bundle of carbon fibers.

A volume fraction of crystallite of the bundle of carbon fibers in the wide-angle x-ray diffraction measurement is preferably 40 to 60%, more preferably 43 to 60%, and still more preferably 45 to 60%. The higher the shear modulus of an amorphous part in the carbon fiber is, the higher the tensile strength of the carbon fiber tends to be. Higher shear modulus and higher volume fraction of crystallite of the carbon fiber indicate higher shear modulus of the amorphous part. The volume fraction of crystallite refers to a volume fraction of crystallite in the carbon fiber, and when the volume fraction of crystallite is 40 to 60%, the shear modulus of the amorphous part often becomes satisfactory. The volume fraction of crystallite is evaluated based on diffraction intensity of artificial graphite from the wide-angle x-ray diffraction measurement of powdered bundle of carbon fibers (details are as provided in "Volume Fraction of Crystallite in Carbon Fiber" described later). In general, the volume fraction of crystallite can be controlled by the temperature of carbonization.

Next, the method of manufacturing a bundle of carbon fibers will be described.

In the method of manufacturing a bundle of carbon fibers, a bundle of precursor fibers for carbon fiber is subjected to oxidation processes, a pre-carbonization process, and a carbonization process to obtain a bundle of carbon fibers. To weaken the nonlinearity of the stress-strain curve of a carbon fiber, it is necessary to control an oxidated fiber obtained when subjecting, particularly, a bundle of precursor fibers for carbon fiber to the oxidation process so that a ratio of a peak intensity at 1453 $cm^{-1}$ to a peak intensity at 1370 $cm^{-1}$ in an infrared spectrum is 0.70 to 0.75 and a ratio of a peak intensity at 1254 $cm^{-1}$ to the peak intensity at 1370 $cm^{-1}$ in the infrared spectrum is 0.50 to 0.65. A peak at 1453 $cm^{-1}$ in the infrared spectrum is derived from alkene, and is reduced as oxidation proceeds. A peak at 1370 $cm^{-1}$ and a peak at 1254 $cm^{-1}$ are those derived from oxidated structures (which seem to be a naphthyridine ring structure and a hydrogenated naphthyridine ring structure, respectively), and are increased as oxidation proceeds. When the obtained oxidated fiber has a specific gravity of 1.35, the ratio of the peak intensity at 1453 $cm^{-1}$ to the peak intensity at 1370 $cm^{-1}$ is about 0.63 to 0.69. In an oxidation process, typically, a peak derived from polyacrylonitrile is reduced as much as possible to increase carbonization yield. However, in our method, conditions of the oxidation process are set so that much alkene is left on purpose. Subjecting the oxidated fiber having such a structure to the pre-carbonization process is effective in increasing the shear modulus of an obtained bundle of carbon fibers. Furthermore, it is important to set the oxidation conditions so that the ratio of the peak intensity at 1254 $cm^{-1}$ to the peak intensity at 1370 $cm^{-1}$ is 0.50 to 0.65. A peak at 1254 $cm^{-1}$ is often seen in insufficiently oxidated parts. If the structure is present in large number, the shear modulus of an obtained carbon fiber seems to be reduced. The peak intensity ratio is reduced as the oxidation proceeds and, particularly, an initial reduction is large. However, depending on oxidation conditions, the peak intensity ratio may not become 0.65 or less even if time is increased.

To strike a balance between the two peak intensity ratios in an intended range, basically, it is enough to set conditions by mainly focusing on reduction of the amount of a copolymerization component included in a polyacrylonitrile-based polymer forming the bundle of precursor fibers for carbon fiber, increase of the orientation parameter of crystallites in the bundle of precursor fibers for carbon fiber, reduction of fiber fineness of the bundle of precursor fibers for carbon fiber, and increase of oxidation temperature in a latter half of the process. Preferably, heat treatment is performed until the ratio of a peak intensity at 1453 $cm^{-1}$ to a peak intensity at 1370 $cm^{-1}$ in an infrared spectrum is 0.98 to 1.10 (first oxidation process), and next, heat treatment is performed in a temperature higher than in the first oxidation process for an oxidation time of 5 to 14 minutes, and preferably 5 to 10 minutes until the ratio of the peak intensity at 1453 $cm^{-1}$ to the peak intensity at 1370 $cm^{-1}$ in the infrared spectrum is 0.70 to 0.75 and the ratio of the peak intensity at 1254 $cm^{-1}$ to the peak intensity at 1370 $cm^{-1}$ in the infrared spectrum is 0.50 to 0.65 (second oxidation process). To reduce the oxidation time in the second oxidation process, oxidation temperature may be adjusted to be increased. An appropriate oxidation temperature is dependent on characteristics of the polyacrylonitrile precursor fiber bundle. It is preferable to set so that the bundle of carbon fibers has a center temperature of preferably 280 to 310° C., more preferably 280 to 300° C., and still more preferably 285 to 295° C. to control to the range of the infrared spectrum described above. The oxidation temperature does not have to be constant and may be set in multiple stages. To increase the shear modulus of an obtained carbon fiber, it is preferable to set the oxidation temperature to high and shorten the oxidation time. In the first oxidation process, the oxidation time is preferably 8 to 25 minutes, and more preferably 8 to 15 minutes, and it is preferable to perform oxidation at an oxidation temperature as included in the above range.

Oxidation time described here refers to a time in which a fiber bundle is retained in an oxidation oven, and the oxidated fiber bundle refers to a fiber bundle before the pre-carbonization process after the oxidation process. Additionally, peak intensity described here refers to an absorbance at each wavelength after baseline correction of a spectrum obtained by sampling a small amount of the oxidated fiber and measuring an infrared spectrum thereof, and peak splitting and the like are not performed unless otherwise needed. Additionally, measurement is performed after diluting samples with KBr to result in a concentration of 0.67% by mass. In this way, conditions may be examined by measuring an infrared spectrum each time oxidation condition setting is changed and according to the preferable manufacturing method described later. The nonlinearity of a stress-strain curve of an obtained carbon fiber can be controlled by appropriately controlling an infrared spectrum peak intensity ratio of the oxidated fiber.

The amount of the copolymerization component included in the polyacrylonitrile-based polymer is preferably 0.1 to 2% by mass, and more preferably 0.1 to 1% by mass. Addition of the copolymerization component is effective in promoting oxidation reaction. However, when the amount of the copolymerization is less than 0.1% by mass, the effect is hardly obtained. In addition, when the amount of the copolymerization exceeds 2% by mass, oxidation of a single-fiber surface layer is preferentially promoted, and oxidation of the inside of the oxidated thread becomes insufficient, as a result of which the above range of infrared spectrum peak intensity ratio is not satisfied in many cases.

Oxidation process refers to performing heat treatment of a bundle of precursor fibers for carbon fiber at 200 to 400° C. in an oxygen atmosphere concentration of ±5% by mass of an oxygen atmosphere concentration in the air.

The total treatment time of the oxidation processes can be selected as appropriate in a range of preferably 13 to 20 minutes. Additionally, to improve the shear modulus of an obtained bundle of carbon fibers, the oxidation treatment time is set so that the specific gravity of the obtained oxidated fiber bundle is preferably 1.28 to 1.32, and more preferably 1.30 to 1.32. A more preferable treatment time for the oxidation processes is dependent on oxidation temperature. Unless the specific gravity of the oxidated fiber bundle is 1.28 or more, the tensile strength of the bundle of carbon fibers may be reduced. When the specific gravity of the oxidated fiber bundle is 1.32 or less, the shear modulus can be increased. The specific gravity of the oxidated fiber bundle is controlled by treatment time and oxidation temperature in the oxidation processes. Additionally, a timing for switching from the first oxidation process to the second oxidation process is preferably set to be in a range in which the specific gravity of the fiber bundle is 1.21 to 1.23. Even in this case, conditions of the oxidation processes are controlled by prioritizing satisfying the above range of infrared spectrum intensity ratio. Preferable ranges of the oxidation treatment time and oxidation temperature vary depending on the characteristics of the bundle of precursor fibers for carbon fiber and the copolymerization composition of the polyacrylonitrile-based polymer.

In the oxidation processes, it is preferable that the specific gravity of the bundle of precursor fibers for carbon fiber is 1.22 or more, and an integrated value of the amount of heat applied to the fiber during heat treatment at 220° C. or more is preferably 50 to 150 J·h/g, and more preferably 70 to 100 J·h/g. By adjusting so that the integrated value of the amount of heat applied in the latter half of the oxidation processes is in the above range, the nonlinearity of the stress-strain curve of an obtained carbon fiber is more easily weakened. The integrated value of the amount of heat is a value obtained by the following formula by using an oxidation temperature T(K), a retention time t (h) in an oxidation oven, and a heat capacity 1.507 J/g·° C. of the polyacrylonitrile-based precursor fiber bundle.

$$\text{Integrated value of amount of heat (J·h/g)} = T \times t \times 1.507$$

When the oxidation processes have a plurality of temperature conditions, the amount of heat may be calculated from a retention time at each temperature and the calculation results may be integrated.

As a raw material for use in manufacturing of the bundle of precursor fibers for carbon fiber, a polyacrylonitrile-based polymer is preferably used. Additionally, the polyacrylonitrile-based polymer refers to a polymer in which acrylonitrile is a main structural component of a polymer skeleton. The main structural component usually refers to a structural component that forms 90 to 100% by mole of the polymer skeleton.

In manufacturing the bundle of precursor fibers for carbon fiber, the polyacrylonitrile-based polymer preferably includes a copolymerization component from the viewpoint of improvement in spinning performance, the viewpoint of efficiency in oxidation treatment, and the like.

As a monomer that can be used as the copolymerization component, monomers containing one or more carboxylic acid groups or amide groups are preferably used from the viewpoint of promotion of oxidation. Examples of monomers containing one or more carboxylic acid groups include acrylic acid, methacrylic acid, itaconic acid, alkali metal salts thereof, and ammonium salts. Additionally, examples of monomers containing one or more amide groups include acrylamide.

In manufacturing the bundle of precursor fibers for carbon fiber, a method of manufacturing the polyacrylonitrile-based polymer can be selected from among well-known polymerization methods.

A description will be given of a method of manufacturing a bundle of precursor fibers for carbon fiber suitable to obtain the bundle of carbon fibers.

In manufacturing the bundle of precursor fibers for carbon fiber, the manufacturing method may use either a dry-jet wet spinning method or a wet spinning method. However, it is preferable to use the dry-jet wet spinning method that is advantageous for the tensile strength of an obtained bundle of carbon fibers. A spinning process includes an extruding process by extruding a spinning dope solution into a coagulation bath through a spinneret by the dry-jet wet spinning method, a water-washing process for washing a fiber obtained by the extruding process in a water bath, a water-bath stretching process for stretching a fiber obtained by the water-washing process in the water bath, and a drying-heat treatment process for drying and heat-treating a fiber obtained by the water-bath stretching process. If necessary, a steam stretching process for steam-extending a fiber obtained by the drying-heat treatment process is preferably included. The spinning dope solution is a solution prepared by dissolving the polyacrylonitrile-based polymer in a solvent that can dissolve a polyacrylonitrile such as dimethyl sulfoxide, dimethylformamide, or dimethylacetamide.

The coagulation bath preferably includes a solvent such as dimethyl sulfoxide, dimethylformamide, or dimethylacetamide used as the solvent for the spinning dope solution and a so-called coagulation-accelerating component. The coagulation-accelerating component usable can be a component that does not dissolve the polyacrylonitrile-based polymer and that has compatibility with a solvent for use in a spinning solution. Specifically, it is preferable to use water as the coagulation-accelerating component.

As the water-washing bath in the water-washing process, it is preferable to use a water-washing bath with a plurality of temperature stages of 30 to 98° C.

In addition, a stretching ratio in the water-bath stretching process is preferably 2 to 6 times, and more preferably 2 to 4 times.

After the water-bath stretching process, an oil agent including silicone and the like is preferably added to fiber threads to prevent adhesion between single-fibers. As the silicone oil agent, a modified silicone is preferably used, and it is preferable to use a silicone oil agent including an amino-modified silicone that is highly heat-resistant.

The drying-heat treatment process can use a known method. For example, a drying temperature of 100 to 200° C. is exemplified.

After the above-described water-washing process, water-bath stretching process, oil agent-addition process, and drying-heat treatment process, steam stretching is performed if necessary, whereby a bundle of precursor fibers for carbon fiber suitable to obtain the bundle of carbon fibers can be obtained. In the steam stretching, it is preferable to extend up to at least two times or more, more preferably 4 times or more, and still more preferably 5 times or more in pressurized steam.

Following the oxidation processes, the pre-carbonization process is preferably performed. In the pre-carbonization process, the obtained oxidated fiber is preferably heat-treated at a maximum temperature of 500 to 1200° C. in an inert atmosphere until the specific gravity thereof becomes 1.5 to 1.8

The pre-carbonized fiber bundle is carbonized at a maximum temperature of 1000 to 3000° C. in an inert atmosphere. The temperature of the carbonization process is preferably set to be high in terms of increasing the tensile modulus of resin-impregnated strands in the obtained carbon fiber. However, when the temperature is extremely high, the strength of a high strength region can be reduced. Thus, it is better to set in consideration of both cases. A more preferable temperature range is 1200 to 2000° C., and a still more preferable temperature range is 1200 to 1600° C.

The bundle of carbon fibers thus obtained is subjected to oxidation treatment to introduce an oxygen-containing functional group to improve adhesion with the matrix resin. As a method of the oxidation treatment, gas phase oxidation, liquid phase oxidation, and liquid phase electrolytic oxidation are used. From the viewpoint of high productivity and uniform treatment, liquid phase electrolytic oxidation is preferably used. The method of liquid phase electrolytic oxidation is not particularly limited, and may be any of known methods.

After the liquid phase electrolytic oxidation, a sizing agent may also be applied to provide converging properties to the obtained bundle of carbon fibers. As for the sizing agent, a sizing agent having good compatibility with the matrix resin can be selected as appropriate depending on the kind of the matrix resin used in the composite.

Measurement Methods for Respective Physical Property Values Used are as Follows. Single-Fiber Loop Test A single-fiber, about 10 cm in length, is placed on a slide glass. One to two droplets of glycerin are dropped on the center thereof, and both ends of the single-fiber are lightly twisted in a circumferential direction of the fiber to form a loop at the center of the single-fiber and place a cover glass thereon. This is installed on a stage of a microscope, and then, video filming is started under conditions of a total magnification of 100 times and a frame rate of 15 frames/second. While adjusting the stage each time so that the loop is not outside the visual field, both ends of the looped fiber are pushed by fingers in a slide glass direction and simultaneously pulled in an opposite direction at a constant speed to apply strain until the single-fiber is fractured. With frame-by-frame playback, a frame just before loop fracture is specified, and a width W of the loop just before loop fracture is measured by image analysis. The fiber diameter d is divided by W to calculate d/W. The number n of tests is 20, and an average value of d/W is multiplied by a tensile modulus of strands to obtain E×d/W.

Single-Fiber Fragmentation Method

Measurement of the number of fiber breaks by the single-fiber fragmentation method is performed in steps (a) to (e):

(a) Preparation of Resin

One hundred and ninety parts by mass of a bisphenol A epoxy resin compound "EPOTOHTO (registered trademark) YD-128" manufactured by Nippon Steel Chemical, Ltd.) and 20.7 parts by mass of diethylenetriamine (manufactured by Wako Pure Chemical Industries, Ltd.) are placed in a container and mixed by a spatula. The mixture is defoamed using an automatic vacuum defoaming device.

(b) Sampling of Carbon Fiber Single-Fiber and Fixing to Mold

A bundle of carbon fibers, about 20 cm in length, was substantially equally divided into four bundles to sample of single-fibers in order from the four bundles. At this time, the fibers are sampled as evenly as possible from the entire bundles. Next, a double-sided tape is applied to both ends of perforated backing paper, and the sampled single-fibers are fixed onto the perforated backing paper in a state where a constant tension is applied to the single-fibers. Next, a glass plate with a polyester film "LUMIRROR (registered trademark)" (manufactured by Toray Industries, Inc.) attached thereon is prepared, and a spacer, 2 mm thickness, to adjust the thickness of a test piece is fixed onto the film. The perforated backing paper with the single-fibers fixed thereon is placed on the spacer, and additionally, a glass plate with the film similarly attached thereon is set on the backing paper such that a side thereof with the film attached thereon faces downward. At this time, to control an embedment depth of the fibers, a tape, about 70 μm in thickness, is attached to both ends of the film.

(c) From Cast Molding of Resin to Curing Thereof

The resin prepared by the step (a) is poured into a mold obtained by the step (b) (a space surrounded by the spacer and the film). The mold with the resin poured therein is heated for 5 hours in an oven whose temperature has been increased to 50° C. in advance, and then, the temperature is reduced to 30° C. at a temperature decrease rate of 2.5° C./min. After that, removal from the mold and cutting are performed to obtain a test piece of 2 cm×7.5 cm×0.2 cm. Then, the test piece is cut so that the single fibers are positioned in a 0.5 cm-wide area at the center of the test piece width.

(d) Measurement of Fiber Embedment Depth

In the test piece obtained by the step (c), measurement of a fiber embedment depth is performed using a laser of Laser Raman Spectroscopy (NRS-3000, JASCO Corporation) and a 532 nm notch filter. First, laser is applied to a single-fiber surface, and a stage height is adjusted so that the beam diameter of the laser becomes smallest. The height at that time is defined as A (μm). Next, laser is applied to a test piece surface, and the stage height is adjusted so that the beam diameter of the laser becomes smallest. The height at that time is defined as B (μm). From the heights A and B thus obtained and a refractive index 1.732 of the resin measured by using the above laser, an embedment depth e (μm) of the fibers is calculated by the following formula:

$$e=(A-B)\times 1.732$$

(e) 4-Point Bending Test

Tensile strain is applied to the test piece obtained by the step (c) by 4-point bending, using a jig having outer indenters attached thereto at an interval of 50 mm and inner indenters attached thereto at an interval of 20 mm, as depicted in FIG. 1. The strain is applied stepwise at each increment of 0.1%, and the test piece is observed though a polarizing microscope to measure the number of breaks of the single-fibers in a 10 mm wide range at the center in a longitudinal direction of the test piece. A value obtained by dividing the measured number of breaks by 10 is defined as the number of fiber breaks (breaks/mm). Additionally, a strain $\varepsilon_1$ (%) was measured by using a strain gauge attached at a position away from the center of the test piece by about 5 mm in the width direction thereof. The number n of tests is 40, and an arithmetic average value of the measurement result is defined as the value of $\varepsilon_1$ (%). A strain $\varepsilon_c$ of a final single-fiber composite is calculated by the following formula from a gauge factor κ of the strain gauge, the fiber embedment depth e (μm) measured by the step (d), and a residual strain 0.14(%).

$$\varepsilon_c = \varepsilon_1 \times \frac{2}{\kappa} \times \frac{(1000-e)}{1000} - 0.14$$

Double-Fiber Fragmentation Method

Measurement of the number of fiber breaks by the double-fiber fragmentation method is performed by steps (f) to (j):

(f) Preparation of Resin

The step is performed in the same manner as the (a).

(g) Sampling of Carbon Fiber Single Fiber and Fixing to Mold

A bundle of carbon fibers, about 20 cm in length is substantially equally divided into four bundles, and the step is performed in the same manner as the (b) except that two single-fibers were sampled from the four bundles, a double-sided tape is attached to both ends of perforated backing paper, and the fibers are fixed so that an interval between the two single-fibers is 0.5 μm to an average single-fiber diameter and the fibers are in parallel in a state where a constant tension is applied to the sampled single-fibers.

(h) From Cast Molding of Resin to Curing Thereof

The step is performed in the same manner as the (c).

(i) Measurement of Fiber Embedment Depth and Measurement of Single-Fiber Interval After measuring a fiber embedment depth as in the (d), a single-fiber interval is measured through an optical microscope. Test uses only composites in which the single-fiber interval is 0.5 μm to an average single-fiber diameter and the fibers are embedded in parallel.

(j) 4-Point Bending Test

Test is performed in the same manner as the (e). In addition, the number n of tests is 20, and 40 single-fibers are tested.

Single-Fiber Modulus of Carbon Fiber

The single-fiber modulus of the carbon fiber is obtained according to JIS R7606 (2000) in the following manner. First, a bundle of carbon fibers, about 20 cm in length, is substantially equally divided into four bundles to sample single-fibers in order from the four bundles. The fibers are sampled as evenly as possible from the entire bundles. The sampled single-fibers are fixed on perforated paper by an adhesive. The paper with the single-fibers fixed thereon is installed in a tensile testing machine, and tensile strength is measured by a tensile test at a gauge length of 50 mm, a strain rate of 2 mm/min, and with the sample number of 20. An arithmetic average value of the measurement result is defined as the value of strength. The modulus is defined by the following formula:

Modulus=(obtained strength)/(cross-sectional area of single-fiber×obtained elongation)

A single-fiber cross-sectional area in the fiber bundle to be measured is obtained by dividing mass per unit length (g/m) by density (g/m$^3$), and additionally by dividing by the number of filaments. The density is measured by Archimedean method by using o-dichloroethylene as a specific gravity solution.

Tensile Strength Test of Strands of Carbon Fiber

The tensile strength test of resin-impregnated strands (tensile modulus E of strands), tensile strength, and stress-strain curve of the carbon fiber are obtained according to JIS R7608 (2008) "Tensile Strength Test of Resin-Impregnated Strands" The tensile modulus E of strands is measured in a strain range of 0.1 to 0.6%, and the initial Young's modulus is obtained from an inclination at a strain of 0 in the stress-strain curve. In addition, test pieces are created by impregnating the following resin composition in a bundle of carbon fibers and under curing conditions of heat treatment at 130° C. for 35 minutes.

Resin Composition 3,4-Epoxycyclohexylmethyl-3,4-epoxy-cyclohexane-carboxylate (100 parts by mass)

Boron Trifluoride Monoethyl Amine (3 parts by mass)

Acetone (4 parts by mass)

In addition, the number of strands to be measured is six, and arithmetic average values of the measurement results are defined as the tensile modulus of strands and tensile strength of the carbon fiber. Additionally, in Examples and Comparative Examples described later, "BAKELITE (registered trademark)" ERL-4221 manufactured by Union Carbide Corporation was used as the above 3,4-Epoxycyclohexylmethyl-3,4-epoxy-cyclohexane-carboxylate. Strain is measured by using an extensometer.

Measurement of Specific Gravity

One point zero to 3.0 g of the fiber is collected and absolutely dried at 120° C. for 2 hours. After measuring an absolutely dry mass $W_1$ (g), the fiber is impregnated with ethanol and sufficiently defoamed. Then, a fiber mass $W_2$ (g) in an ethanol bath is measured to obtain a fiber specific gravity by specific gravity=$(W_1\times\rho)$ $(W_1-W_2)$. ρ represents the specific gravity of ethanol.

Volume Fraction of Crystallite in Carbon Fiber

A carbon fiber to be measured is cut into pieces having a length of 2 to 3 mm by a pair of scissors and then are pulverized for 10 to 20 minutes in an agate mortar until the fiber shape is lost. Into 180 mg of the carbon fiber powder thus obtained are mixed 300 mg of silica gel powder and 20 mg of silicone powder (100 mesh) to prepare a test sample for wide-angle x-ray diffraction measurement. The prepared test sample is subjected to measurement using a wide-angle x-ray diffraction device under the following conditions:

X-ray source: CuKα ray (tube voltage: 40 kV; tube current: 30 mA)

Detector: goniometer+monochrometer+scintillation counter

Scanning range: 2θ=10 to 40°

Scanning mode: step scan, step unit 0.01°, counting time 1 sec.

In the obtained diffraction pattern, after removing peaks derived from the silica gel powder and the silicone powder by using a silicone powder (100 mesh) as a reference material, an integrated intensity $X_1$ of the carbon fiber subjected to Lorentz correction and normalization with a peak area value of the silicone powder is obtained. Artificial graphite is also subjected to the same measurement to obtain an integrated intensity $X_{100}$ at that time. From the integrated intensities $X_1$ and $X_{100}$ thus obtained, a specific gravity $B_1$ of the carbon fiber, and a specific gravity $B_{100}$ of the artificial graphite, an volume fraction $A_1$ (%) of crystallites in the carbon fiber is obtained according to the following formula:

$$A_1=X_1\times B_{100}/(B_1\times X_{100})\times 100$$

In addition, in Examples and Comparative Examples described later, XRD-6100 manufactured by Shimadzu Corporation was used as the wide-angle x-ray diffraction device mentioned above.

Orientation Parameter Π of Crystallites in Bundle of Carbon Fibers

The bundle of carbon fibers to be measured is pulled and aligned, and then hardened by using a collodion alcohol solution to prepare a test sample of quadrangular prism, 4 cm in length and 1 mm in side length. The prepared test sample is subjected to measurement using a wide-angle x-ray diffraction device under the following conditions:

X-ray source: CuKα ray (tube voltage: 40 kV; tube current: 30 mA)

Detector: goniometer+monochrometer+scintillation counter

From a half-width H (°) of a diffraction intensity distribution obtained by scanning a peak appearing near 2θ=25 to 26° in a circumferential direction, the orientation parameter Π (%) of crystallites is obtained by using the following formula:

$$\text{Orientation parameter } \Pi\ (\%) \text{ of crystallites}=[(180-H)/180]\times 100$$

In addition, as the wide-angle x-ray diffraction device mentioned above, XRD-6100 manufactured by Shimadzu Corporation is used.

Average Single-Fiber Diameter of Carbon Fiber

Regarding the bundle of carbon fibers composed of multiple carbon filaments to be measured, a mass $A_f$ (g/m) and a specific gravity $B_f$ (g/cm$^3$) per unit length are obtained. From values of the obtained $A_f$ and $B_f$ and the number of the filaments of the bundle of carbon fibers $C_f$ to be measured, an average single-fiber diameter (μm) of the carbon fiber is calculated by the following formula:

$$\text{Average single-fiber diameter } (\mu m) \text{ of carbon fiber}=((A_f/B_f/C_f)/\pi)^{(1/2)}\times 2\times 10^3$$

Infrared Spectrum Intensity Ratio

After freezing and pulverizing an oxidated fiber to be measured, 2 mg of the pulverized fiber is precisely weighed and collected. The collected fiber is mixed well with 300 mg of KBr, placed into a molding jig, and then pressurized for 2 minutes at 40 MPa by using a press machine to produce a test tablet. The tablet is installed in a Fourier transform infrared spectrophotometer to measure a spectrum of 1000 to 2000 cm$^{-1}$. Additionally, background correction is performed by reducing a minimum value of 1700 to 2000 cm$^{-1}$ from each intensity so that the minimum value becomes "0". In addition, as the above Fourier transform infrared spectrophotometer, PARAGON 1000 manufactured by Perkin Elmer Co., Ltd., was used.

0° Tensile Strength of Carbon Fiber-Reinforced Composite

As described in JIS K7017 (1999), a fiber direction of unidirectional carbon fiber-reinforced composite is defined as an axial direction thereof, and the axial direction is defined as a 0° axis, and an axially orthogonal direction is defined as a 90° axis. A unidirectional prepreg within 24 hours after production is cut into pieces with a predetermined size, six pieces of which are unidirectionally stacked and cured at a temperature of 180° C. and a pressure of 6 kg/cm$^2$ for 2 hours in an autoclave by a vacuum bag method to obtain an unidirectional reinforced material (a carbon fiber-reinforce composite). The unidirectional reinforced material is cut into a shape having a width of 12.7 mm and a length of 230 mm, and a 1.2 mm glass fiber-reinforced plastic tab having a length of 50 mm is bonded to both ends of the material to obtain a test piece. The test piece thus obtained is subjected to a tensile strength test at a crosshead speed of 1.27 mm/min by using a universal testing machine manufactured by Instron Corporation to obtain a 0° tensile strength.

EXAMPLES

Examples 1 to 8 and Comparative Examples 1 to 10

A copolymer containing 99.0% by mass of acrylonitrile and 1.0% by mass of itaconic acid (but, in Comparative Example 8, a copolymer containing 97.0% by mass of acrylonitrile and 3.0% by mass of itaconic acid) were polymerized in dimethyl sulfoxide as a solvent by a solution polymerization method to obtain a spinning solution containing a polyacrylonitrile-based copolymer. Using a dry-jet wet spinning method, the obtained spinning solution was once extruded into the air through a spinneret and then introduced into a coagulation bath containing an aqueous solution of dimethyl sulfoxide to obtain a coagulated fiber thread.

The coagulated fiber thread was water-washed by a usual method and, then, extended up to 3.5 times in two hot water baths. Next, an amino modified silicone-based silicone oil agent was applied to the fiber bundle after the water bath stretching, and drying and densification treatment was performed by using a roller heated to 160° C. The number of the single-fibers to be extended was set to 12000, and then the single-fibers were extended up to 3.7 times in pressurized steam to allow the total stretching magnification in spinning to become 13 times. After that, interlacing treatment was performed to obtain a bundle of precursor fibers for carbon fiber having an orientation parameter of crystallites of 93% and containing 12000 single-fibers. The bundle of precursor fibers for carbon fiber had a single-fiber fineness of 0.7 dtex. However, Comparative Example 10 had a single-fiber fineness of 0.5 dtex. Next, using conditions of oxidation temperature and oxidation time shown in Table 1 regarding Examples 1 to 7 and Comparative Examples 1 to 8 and 10, Table 2 regarding Example 8, and Table 3 regarding Comparative Example 9, oxidation treatment was performed while extending the bundle of precursor fibers for carbon fiber at an stretching ratio of 1 in an oven with air atmosphere to obtain an oxidated fiber bundle shown in each of Tables 1 to 3.

TABLE 1

| | Oxidation temperature | | | Oxidation time | | | Amount of heat applied in a specific gravity range of 1.22 or more | After oxidation in first oven | | Oxidated fiber bundles | | |
|---|---|---|---|---|---|---|---|---|---|---|---|---|
| | | | | | | | | | IR peak intensity ratio | | IR peak intensity ratio | |
| | First oven ° C. | Second oven ° C. | Third oven ° C. | First oven Min. | Second oven Min. | Third oven Min. | J · h/g | Specific gravity — | 1453 $cm^{-1}$/1370 $cm^{-1}$ — | Specific gravity — | 1453 $cm^{-1}$/1370 $cm^{-1}$ — | 1254 $cm^{-1}$/1370 $cm^{-1}$ — |
| Co. ex. 1 | 250 | 270 | — | 15 | 15 | — | 205 | 1.22 | 0.96 | 1.34 | 0.66 | 0.60 |
| Co. ex. 2 | 236 | 246 | — | 16.7 | 16.7 | — | 153 | 1.20 | 1.22 | 1.24 | 0.85 | 0.65 |
| Co. ex. 3 | 250 | 290 | — | 12.5 | 11.5 | — | 161 | 1.21 | 1.01 | 1.40 | 0.58 | 0.58 |
| Co. ex. 4 | 250 | 270 | 285 | 12.5 | 1 | 1 | 25 | 1.21 | 1.01 | 1.24 | 0.84 | 0.65 |
| Co. ex. 5 | 250 | 270 | — | 14.4 | 20.5 | — | 280 | 1.22 | 0.97 | 1.37 | 0.62 | 0.59 |
| Ex. 1 | 250 | 285 | — | 11 | 6 | — | 80 | 1.21 | 1.04 | 1.30 | 0.72 | 0.62 |
| Co. ex. 6 | 250 | 285 | — | 22 | 6 | — | 229 | 1.24 | 0.85 | 1.33 | 0.66 | 0.61 |
| Co. ex. 7 | 250 | 260 | — | 11 | 8 | — | 103 | 1.21 | 1.02 | 1.27 | 0.79 | 0.64 |
| Ex. 2 | 250 | 281 | — | 11 | 6 | — | 81 | 1.21 | 1.04 | 1.30 | 0.70 | 0.61 |
| Ex. 3 | 250 | 289 | — | 8 | 6 | — | 78 | 1.20 | 1.10 | 1.29 | 0.73 | 0.62 |
| Ex. 4 | 250 | 282 | — | 11 | 7 | — | 96 | 1.21 | 1.05 | 1.30 | 0.71 | 0.62 |
| Ex. 5 | 250 | 283 | — | 12 | 6 | — | 82 | 1.21 | 1.00 | 1.29 | 0.72 | 0.62 |
| Ex. 6 | 245 | 284 | — | 14 | 6 | — | 82 | 1.21 | 1.06 | 1.29 | 0.72 | 0.62 |
| Ex. 7 | 240 | 286 | — | 16 | 6 | — | 82 | 1.21 | 1.07 | 1.30 | 0.71 | 0.62 |
| Co. ex. 8 | 250 | 285 | — | 5 | 6 | — | 84 | 1.22 | 0.99 | 1.41 | 0.57 | 0.67 |
| Co. ex. 10 | 250 | 290 | — | 12.5 | 11.5 | — | 161 | 1.21 | 1.01 | 1.40 | 0.58 | 0.58 |

TABLE 2

| Ex. 8 | | | | | | |
|---|---|---|---|---|---|---|
| | | | IR peak intensity ratio | | | Amount of heat applied in a range of a |
| | Oxidation temperature ° C. | Oxidation time Min. | 1453 $cm^{-1}$/1370 $cm^{-1}$ — | 1254 $cm^{-1}$/1370 $cm^{-1}$ — | Specific gravity — | specific gravity of 1.22 or more J · h/g |
| First oven | 250 | 3 | 1.37 | — | 1.18 | — |
| Second oven | 250 | 3 | 1.28 | — | 1.19 | — |
| Third oven | 250 | 3 | 1.08 | — | 1.20 | — |
| Fourth oven | 250 | 2 | 1.04 | — | 1.21 | — |
| Fifth oven | 285 | 3 | 0.79 | 0.63 | 1.27 | 84 |
| Sixth oven | 285 | 3 | 0.72 | 0.62 | 1.30 | |

TABLE 3

| Co. ex. 9 | | | | | | |
|---|---|---|---|---|---|---|
| | | | IR peak intensity ratio | | | Amount of heat applied in a specific gravity |
| | Oxidation temperature ° C. | Oxidation time Min. | 1453 $cm^{-1}$/1370 $cm^{-1}$ — | 1254 $cm^{-1}$/1370 $cm^{-1}$ — | Specific gravity — | range of of 1.22 or mroe J · h/g |
| First oven | 235 | 12 | 1.30 | — | 1.18 | — |
| Second oven | 240 | 12 | 1.01 | — | 1.21 | — |
| Third oven | 245 | 12 | 0.89 | 0.65 | 1.24 | 550 |
| Fourth oven | 250 | 12 | 0.73 | 0.63 | 1.28 | |
| Fifth oven | 255 | 12 | 0.71 | 0.62 | 1.30 | |
| Sixth oven | 260 | 12 | 0.64 | 0.60 | 1.36 | |

In Table 1, oxidation process in "First oven" corresponds to the first oxidation process, and oxidation process in "Second oven" (in Comparative Example 4, "Second oven" and "Third oven") corresponds to the second oxidation process. In addition, in Table 2, oxidation process in "First oven", "Second oven", "Third oven", and "Fourth oven" corresponds to the first oxidation process, and oxidation process in "Fifth oven" and "Sixth oven" corresponds to the second oxidation process. In Table 3, oxidation process in "First oven" and "Second oven" corresponds to the first oxidation process, and oxidation process in "Third oven", "Fourth oven" "Fifth oven", and "Sixth oven" corresponds to the second oxidation process.

Additionally, the number of oxidation ovens that perform the first oxidation process and the second oxidation process is not limited. For example, Example 1 performed oxidation at 250° C. for 11 minutes in "First oven" and at 285° C. for 6 minutes in "Second oven", whereas Example 8 performed oxidation by a six-oven structure that performed the first oxidation process in the fourth ovens and the second oxidation process in the two ovens.

The obtained oxidated fiber bundle was subjected to pre-carbonization treatment while extending at a stretching ratio of 1.15 in a nitrogen atmosphere at a temperature of 300 to 800° C., whereby a pre-carbonized fiber bundle was obtained. The obtained pre-carbonized fiber bundle was subjected to carbonization treatment at a maximum temperature of 1500° C. and a tension of 14 mN/dTex in a nitrogen atmosphere. The obtained bundle of carbon fibers was subjected to surface treatment and sizing agent coating treatment to produce a final bundle of carbon fibers, whose physical properties are shown in Tables 4-1 to 4-3. In addition, Comparative Example 1 was performed following oxidation conditions of Example 4 of Japanese Unexamined Patent Application Publication No. 2012-082541; Comparative Example 2 was performed following oxidation conditions of Example 1 of Japanese Unexamined Patent Application Publication No. 2009-242962; Comparative Example 3 was performed following oxidation conditions of Example 1 of Japanese Unexamined Patent Application Publication No. 2012-082541; Comparative Example 4 was performed following oxidation conditions of Example 3 of Japanese Unexamined Patent Application Publication No. 2012-082541; and Comparative Example 5 was performed following oxidation conditions of Example 7 of Japanese Unexamined Patent Application Publication No. 2012-082541.

Oxidated fiber bundles of Comparative Examples 2 and 4 had fiber fracture in the carbonization process due to shortage of oxidation, and no carbon fiber was obtained. In addition, as Reference Examples 1, 2, and 3, Table 5 shows physical properties of oxidated fiber bundles manufactured by totally following Examples 1, 3, and 7, respectively, of Japanese Unexamined Patent Application Publication No. 2012-082541. In Comparative Examples 3, 4, and 5, conditions for manufacturing a bundle of precursor fibers for carbon fiber are different from manufacturing conditions described in Japanese Unexamined Patent Application Publication No. 2012-082541. Thus, the oxidated fiber bundles exhibit characteristics different between Reference Examples 1, 2, and 3 and Comparative Examples 3, 4, and 5.

As can be seen from Table 4-3, bundles of carbon fibers of Examples 1 to 8 had a tensile strength of 7.5 GPa or more, whereas those of Comparative Examples 1 to 9 did not have a tensile strength of 7.5 GPa or more.

Furthermore, to evaluate characteristics of carbon fiber-reinforced composites using the obtained bundle of carbon fibers, the bundles of carbon fibers of Example 1 and Comparative Example 10 were subjected to carbon fiber-reinforced composite evaluation in the following steps. In addition, Comparative Example 10 performed oxidation and carbonization in the same conditions as those of Comparative Example 3, but had higher tensile strength than Comparative Example 3 due to reduction of surface flaws caused by reduction of single-fiber fineness. Using an ammonium hydrogen carbonate aqueous solution having a concentration of 0.1 mol/1 as an electrolyte, the bundles of carbon fibers were subjected to electrolytic surface treatment with a quantity of electricity of 80 coulombs per g of carbon fiber. The carbon fibers subjected to electrolytic surface treatment were water-washed and dried in air heated to 150° C. to obtain electrolyzed bundle of carbon fibers. Next, the obtained bundle of carbon fibers was subjected to sizing agent coating treatment by a sizing solution including "DENACOL (registered trademark)" EX-521 (Nagase ChemteX Corporation) to obtain a bundle of sizing agent-coated carbon fibers. Using the sizing agent-coated bundle of carbon fibers, prepregs were produced in the following steps. First, after kneading and dissolving 35 parts by mass of tetraglycidyl diaminodiphenylmethane "SUMI-EPDXY (registered trademark)" ELM 434 (manufactured by Sumitomo Chemical Co., Ltd.), 35 parts by mass of bisphenol A diglycidyl ether "JER (registered trademark)" 828 (manufactured by Mitsubishi Chemical Corporation), 30 parts by mass of N-diglycidylaniline GAN (manufactured by Nippon Kayaku Co., Ltd.), and 14 parts by mass of SUMIKAEXCEL (registered trademark) 5003P in a kneading device, 40 parts by mass of 4,4'-diaminodiphenyl sulfone was additionally added and kneaded to produce an epoxy resin composition for a carbon fiber-reinforced composite. The obtained epoxy resin composition was coated on release paper with a resin weight of 52 g/m$^2$ by using a knife coater to produce a resin film. The resin film was stacked on both sides of the sizing agent-coated carbon fiber (weight: 190 g/m$^2$) pulled and aligned unidirectionally. The sizing agent-coated carbon fiber was impregnated with the epoxy resin composition while being heated and pressurized at a temperature of 100° C. and an atmospheric pressure of 1 by using a heat roll, whereby a prepreg was obtained.

A carbon fiber-reinforced composite was produced by using the prepreg, and 0° tensile strength was evaluated. Table 4-3 shows the results. In Example 1 and Comparative Example 10, the tensile strength of the bundle of carbon fibers was equally 7.6, but, as for the 0° tensile strength of the carbon fiber-reinforced composite, Example 1 was superior to Comparative Example 10.

TABLE 4-1

| | Bundle of carbon fibers | | | | |
|---|---|---|---|---|---|
| | $(0.0000832\Pi^2 - 0.0184\Pi + 1.00)/A$ — | Orientation parameter Π of crystallite % | A 14.0 | E × d/W Gpa | Weibull shape parameter m of E × d/W — |
| Co. ex. 1 | −362 | 83 | $-1.30 \times 10^{-4}$ | 14.0 | 11 |
| Co. ex. 2 | No CF was obtained due to fracture in carbonization | | | | |
| Co. ex. 3 | −404 | 83 | $-1.16 \times 10^{-4}$ | 13.2 | 11 |
| Co. ex. 4 | No CF was obtained due to fracture in carbonization | | | | |
| Co. ex. 5 | −383 | 83 | $-1.23 \times 10^{-4}$ | 12.5 | 11 |
| Ex. 1 | −446 | 84 | $-9.30 \times 10^{-5}$ | 15.4 | 15 |
| Co. ex. 6 | −428 | 83 | $-1.10 \times 10^{-4}$ | 14.2 | 15 |
| Co. ex. 7 | −362 | 83 | $-1.30 \times 10^{-4}$ | 13.3 | 6 |
| Ex. 2 | −447 | 83 | $-1.05 \times 10^{-4}$ | 15.0 | 16 |
| Ex. 3 | −436 | 84 | $-9.73 \times 10^{-5}$ | 15.3 | 15 |

TABLE 4-1-continued

| | Bundle of carbon fibers | | | | |
|---|---|---|---|---|---|
| | $(0.0000832\Pi^2 - 0.0184\Pi + 1.00)/A$ — | Orientation parameter Π of crystallite % | A 14.0 | E × d/W Gpa | Weibull shape parameter m of E × d/W — |
| Ex. 4 | −451 | 84 | $-9.41 \times 10^{-5}$ | 15.1 | 16 |
| Ex. 5 | −449 | 84 | $-9.46 \times 10^{-5}$ | 15.4 | 14 |
| Ex. 6 | −447 | 84 | $-9.50 \times 10^{-5}$ | 14.9 | 17 |
| Ex. 7 | −460 | 84 | $-9.24 \times 10^{-5}$ | 14.8 | 16 |
| Co. ex. 8 | −362 | 82 | $-1.43 \times 10^{-4}$ | 11.5 | 8 |
| Ex. 8 | −446 | 84 | $-9.30 \times 10^{-5}$ | Not evaluated | |
| Co. ex. 9 | −340 | 83 | $-1.38 \times 10^{-4}$ | | |
| Co. ex. 10 | −394 | 83 | $-1.19 \times 10^{-4}$ | 13.2 | 9 |

TABLE 4-2

| | Apparent single-fiber stress GPa | Double-fiber fragmentation method Number of fiber breaks breaks/mm | Single-fiber fragmentation method Apparent single-fiber stress = 15.3 GPa Number of fiber breaks breaks/mm |
|---|---|---|---|
| Ex. 1 | 9.4 | 0.27 | 2.10 |
| Co. ex. 7 | 8.1 | 0.46 | 2.05 |

TABLE 4-2-continued

| | Apparent single-fiber stress GPa | Double-fiber fragmentation method Number of fiber breaks breaks/mm | Single-fiber fragmentation method Apparent single-fiber stress = 15.3 GPa Number of fiber breaks breaks/mm |
|---|---|---|---|
| Ex. 2 | 9.7 | 0.35 | 2.03 |
| Co. ex. 10 | 9.3 | 0.45 | 2.21 |

TABLE 4-3

| | Bundle of carbon fibers | | | | Carbon fiber-reinforced composites |
|---|---|---|---|---|---|
| | Tensile strength GPa | Initial Young's modulus GPa | Young's modulus GPa | Volume fraction of crystallite % | 0° tensile strength GPa |
| Co. ex. 1 | 6.9 | 315 | 350 | 46 | Not evaluated |
| Co. ex. 2 | CF was not obtained due to fracture by carbonization | | | | |
| Co. ex. 3 | 7.3 | 315 | 350 | 46 | Not evaluated |
| Co. ex. 4 | CF was not obtained due to fracture by carbonization | | | | |
| Co. ex. 5 | 7.1 | 315 | 350 | 45 | Not evaluated |
| Ex. 1 | 7.6 | 315 | 350 | 48 | 4.2 |
| Co. ex. 6 | 7.1 | 315 | 350 | 46 | Not evaluated |
| Co. ex. 7 | 6.5 | 315 | 350 | 49 | |
| Ex. 2 | 7.6 | 315 | 350 | 48 | |
| Ex. 3 | 7.5 | 310 | 345 | 47 | |
| Ex. 4 | 7.6 | 315 | 350 | 47 | |
| Ex. 5 | 7.6 | 315 | 350 | 48 | |
| Ex. 6 | 7.8 | 315 | 350 | 47 | |
| Ex. 7 | 7.9 | 315 | 350 | 48 | |
| Co. ex. 8 | 6.0 | 280 | 310 | 46 | |
| Ex. 8 | 7.6 | 315 | 350 | 48 | |
| Co. ex. 9 | 7.0 | 315 | 350 | 46 | |
| Co. ex. 10 | 7.6 | 315 | 350 | 46 | 3.9 |

TABLE 5

| | Oxidation temperature | | | Oxidation time | | | Amount of heat applied in a specific gravity range of 1.22 or more J · h/g | After oxidation in first oven | | Oxidated fiber bundles | | |
|---|---|---|---|---|---|---|---|---|---|---|---|---|
| | | | | | | | | | IR peak intensity ratio | | IR peak intensity ratio | |
| | First oven ° C. | Second oven ° C. | Third oven ° C. | First oven Min. | Second oven Min. | Third oven Min. | | Specific gravity — | $1453\ cm^{-1}/1370\ cm^{-1}$ — | Specific gravity — | $1453\ cm^{-1}/1370\ cm^{-1}$ — | $1254\ cm^{-1}/1370\ cm^{-1}$ — |
| Ref. ex 1 | 250 | 290 | — | 12.5 | 11.5 | — | 243 | 1.27 | 0.78 | 1.44 | 0.52 | 0.56 |
| Ref. ex 2 | 250 | 270 | 285 | 12.5 | 1 | 1 | 112 | 1.27 | 0.78 | 1.29 | 0.76 | 0.63 |
| Ref. ex 3 | 250 | 270 | — | 14.4 | 20.5 | — | 369 | 1.27 | 0.78 | 1.41 | 0.58 | 0.58 |

In addition, Table 6 shows characteristics of commercially available carbon fibers and well-known carbon fibers, for reference.

TABLE 6

| | Catalog value | | Characteristics of individual bobbins | | | | | |
|---|---|---|---|---|---|---|---|---|
| | | | Initial | | Orientation | | | |
| | Tensile strength GPa | Young's modulus GPa | Tensile strength GPa | Young's modulus GPa | $(0.0000832\Pi^2 - 0.0184\Pi + 1.00)/A$ — | parameter Π of crystallites % | A — | E × d/W Gpa |
| T800S | 5.8 | 294 | 6.0 | 240 | −279 | 83.0 | $-1.65 \times 10^{-4}$ | 12.3 |
| T1000G | 6.4 | 294 | 6.5 | 265 | −358 | 83.1 | $-1.27 \times 10^{-4}$ | Not evaluated |
| T1100G | 6.6 | 324 | 7.2 | 310 | −391 | 84.7 | $-9.83 \times 10^{-5}$ | 14.5 |
| M30S | 5.5 | 294 | 5.1 | 260 | −330 | 83.3 | $-1.35 \times 10^{-4}$ | 11.8 |

| | Characteristics of individual bobbins | | | Carbon fiber-reinforced composites |
|---|---|---|---|---|
| | Apparent single-fiber stress GPa | Double-fiber fragmentaton method Number of fiber breaks breaks/mm | Single-fiber fragmentation method Apparent single-fiber stress = 15.3 GPa Number of fiber breaks breaks/mm | 0° tensile strength GPa |
| T800S | 7.6 | 0.44 | 2.07 | 3.1 |
| T1000G | 8.2 | 0.45 | 2.04 | Not evaluated |
| T1100G | 9.2 | 0.43 | 2.11 | 3.7 |
| M30S | 7.5 | 0.28 | 0.74 | Not evaluated |

The invention claimed is:

1. A bundle of carbon fibers in which a relationship between a coefficient A obtained from a nonlinear approximation formula (1) of a stress σ-strain ε curve in a tensile strength test of resin-impregnated strands is a stress range of 0 to 3 GPa and an orientation parameter Π (%) of crystallites in a wide-angle x-ray diffraction measurement satisfies formula (2) and whose tensile strength is 7.5 GPa or more:

$$\varepsilon = A\sigma^2 + B\sigma + C \quad (1)$$

$$0.0000832\Pi^2 - 0.0184\Pi + 1.00)/A \leq -395 \quad (2)$$

wherein A, B, and C are coefficients of a quadratic function of stress σ and strain ε, and A<0.

2. The bundle according to claim 1, wherein the orientation parameter Π (%) of crystallites in the wide-angle x-ray diffraction measurement is 82% or more.

3. The bundle according to claim 1, wherein an initial Young's modulus in the tensile strength test of resin-impregnated strands is 280 GPa or more.

4. The bundle according to claim 1, wherein the volume fraction of crystallites in the wide-angle x-ray diffraction measurement is 40 to 60%.

5. A bundle of carbon fibers whose tensile modulus in a tensile strength test of resin-impregnated strands is 240 to 440 GPa and in which a product E×d/W of a ratio d/W of a single-fiber diameter d to a loop width W just before loop fracture evaluated by a single-fiber loop test and a tensile modulus E of the strands is 14.6 GPa or more.

6. The bundle according to claim 5, wherein a Weibull shape parameter m in a Weibull plot of the value of E×d/W evaluated with respect to 20 single-fibers is 12 or more.

7. The bundle according to claim 5, wherein an initial Young's modulus in the tensile strength test of resin-impregnated strands is 280 GPa or more.

8. The bundle according to claim 5, wherein the volume fraction of crystallites in the wide-angle x-ray diffraction measurement is 40 to 60%.

9. A bundle of carbon fibers whose apparent single-fiber stress is 8.5 GPa or more when the number of fiber breaks by a single-fiber fragmentation method for a single-fiber composite of a carbon fiber is 0.30 breaks/mm and in which when the number of the fiber breaks by the single-fiber fragmentation method for the single-fiber composite of the carbon fiber is 0.30 breaks/mm, the number of fiber breaks by a double-fiber fragmentation method for the single-fiber composite of the carbon fiber is 0.24 to 0.42 breaks/mm.

10. The bundle according to claim 9, wherein, in the single-fiber fragmentation method for the single-fiber composite of the carbon fiber, when the apparent single-fiber stress is 15.3 GPa, the number of fiber breaks is 2.0 breaks/mm or more.

11. The bundle according to claim 9, wherein an initial Young's modulus in the tensile strength test of resin-impregnated strands is 280 GPa or more.

12. The bundle according to claim 9, wherein the volume fraction of crystallites in the wide-angle x-ray diffraction measurement is 40 to 60%.

13. A method of manufacturing a bundle of carbon fibers comprising:

performing a first oxidation process that oxidates a bundle of precursor fibers for polyacrylonitrile-based carbon fiber for 8 to 25 minutes until a ratio of a peak intensity at 1453 $cm^{-1}$ to a peak intensity at 1370 $cm^{-1}$ in an infrared spectrum is 0.98 to 1.10;

additionally performing a second oxidation process that oxidates for 5 to 14 minutes until the ratio of the peak intensity at 1453 $cm^{-1}$ to the peak intensity at 1370 $cm^{-1}$ in the infrared spectrum is 0.70 to 0.75 and a ratio of a peak intensity at 1254 $cm^{-1}$ to the peak intensity at 1370 $cm^{-1}$ in the infrared spectrum is 0.50 to 0.65 to obtain an oxidated fiber bundle; and then performing a carbonization process that carbonizes the oxidated fiber bundle in an inert atmosphere at 1000 to 3000° C.

14. The method according to claim 13, wherein a total treatment time of the oxidation processes is 13 to 20 minutes.

15. The method according to claim 14, wherein, in the bundle of precursor fibers for polyacrylonitrile-based carbon fiber, a copolymerization component with an amount of 0.1 to 2% by mass of a total monomer component is copolymerized with acrylonitrile.

16. The method according to claim 13, wherein oxidation is performed so that the fiber in the oxidation processes has a specific gravity of 1.22, and an integrated value of the amount of heat applied during heat treatment at 220° C. or more is 50 to 150 J·h/g.

17. The method according to claim 16, wherein, in the bundle of precursor fibers for polyacrylonitrile-based carbon fiber, a copolymerization component with an amount of 0.1 to 2% by mass of a total monomer component is copolymerized with acrylonitrile.

18. The method according to claim 13, wherein oxidation is performed so that the obtained oxidated fiber bundle has a specific gravity of 1.28 to 1.32.

19. The method according to claim 18, wherein, in the bundle of precursor fibers for polyacrylonitrile-based carbon fiber, a copolymerization component with an amount of 0.1 to 2% by mass of a total monomer component is copolymerized with acrylonitrile.

20. The method according to claim 13, wherein, in the bundle of precursor fibers for polyacrylonitrile-based carbon fiber, a copolymerization component with an amount of 0.1 to 2% by mass of a total monomer component is copolymerized with acrylonitrile.

* * * * *